United States Patent [19]

Hoffman

[11] Patent Number: 5,042,415

[45] Date of Patent: Aug. 27, 1991

[54] VEHICLE HANDLING SYSTEM FOR SUBMERSIBLES

[75] Inventor: Robert T. Hoffman, Kailua, Hi.

[73] Assignee: The United States of America as represented by the Secretary of the Navy, Washington, D.C.

[21] Appl. No.: 481,824

[22] Filed: Feb. 7, 1990

[51] Int. Cl.[5] ..... B63G 8/41

[52] U.S. Cl. ..... 114/322; 212/191

[58] Field of Search ..... 114/312, 313, 322, 333, 114/365, 366, 258, 259, 261; 212/191, 446; 254/277; 414/139.6

[56] References Cited

U.S. PATENT DOCUMENTS

| | | | |
|---|---|---|---|
| 3,136,529 | 6/1964 | Dickinson et al. | 254/134.3 |
| 3,296,995 | 1/1967 | Van der Linde . | |
| 3,398,715 | 8/1968 | Burg | 114/244 |
| 3,541,588 | 11/1970 | Ragland . | |
| 3,596,070 | 7/1971 | McCool et al. | 235/151 |
| 3,641,961 | 2/1972 | Howard | 114/268 |
| 3,955,522 | 5/1976 | Gandiano et al. | 114/312 |

OTHER PUBLICATIONS

Yumori, I. R., Advanced Tethered Vehicle Surface Handling System Test, Technical Report 1293, Naval Ocean System Center, Dec. 1988.

*Primary Examiner*—Jesus D. Sotelo

*Attorney, Agent, or Firm*—Harvey Fendelman; Thomas G. Keough; Michael A. Kagan

[57] ABSTRACT

The present invention provides an apparatus for launching and recovering a submersible vessel from a ship, and includes a gantry that pivots in an arc extending over and beyond the aft deck of the ship. A lift line passes about a head sheave that pivots from the top of the gantry and threads through a saddle that also pivots from the top of the gantry. The saddle is clamped to the vessel. The lift line is connected to the top of the submersible vessel and passes about a ram tensioner which may be mounted on the deck. After a winch pays out the lift line to lower the vessel into the ocean, the saddle is disconnected from the vessel and the lift line is rethreaded back out of the saddle. A tether provides a communicative link between the ship and the vessel, and may pass about a hanging sheave suspended from the gantry when the vessel is in the ocean. Recovery of the vessel is the reverse of deployment.

19 Claims, 9 Drawing Sheets

VEHICLE HANDLING SYSTEM FOR SUBMERSIBLES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to the field of deploying, operating, and recovering a tethered submersible vessel from a ship.

Submersibles are launched from ships by a variety of vehicle handling systems utilizing cranes, lines, and tethers. Tethered vehicle handling systems are classified into two types: submersible only, and submersible with support cage. Some systems use the tether for lowering the submersible; others use a separate line.

The submersible only system generally consists of a neutrally buoyant vehicle and a tether cable coupled to a support platform such as the deck of a ship. A section of the tether near the submersible is rendered neutrally buoyant with floatation collars in order to decouple transmission of tensile forces through the tether due to relative motion between the ship and the submersible. Standard procedure requires the deploying ship to stop during launch and recovery of the submersible. Immediately after launch, a submersible deployed with this type of system floats near the support ship. In an adverse sea or wind, the submersible is easily pulled beneath the deploying ship by propwash or suction as the ship heaves. Shock loads induced in the tether due to relative motion between the ship and submersible may be high, even if a separate lift line is used to support the weight of the submersible during launch and recovery operations. If the submersible is supported by the tether cable during launch and recovery, relative horizontal motion between the submersible and the support ship will cause the vehicle to be towed. Since the tether cable generally exits the center top of the vehicle in this configuration, the vehicle will be rolled over, causing high bending loads to be applied to the cable termination point.

The vehicle/cage combination system was developed to overcome the launch and recovery problems of the submersible only system at the sea surface. With the vehicle/cage system, the neutrally buoyant vehicle is mated to a heavy support cage. The cage and vehicle may easily plunge through the sea surface and be lowered to operating depth where the vehicle unmates from the cage. The vehicle swims off as a neutrally buoyant secondary cable is fed from the cage. There are several inherent problems with this approach which are moderate for shallow systems and severe for deep diving ones. Due to ship induced motion of the cage, the cage or vehicle can be easily damaged during recovery operations when the cage and vehicle are re-mated. If mating cannot be accomplished, the recovery of the separate cage and vehicle without damaging the secondary cable becomes very difficult.

The problem of relative vertical motion between the cage and the vehicle can be solved with difficulty by providing motion compensation at the surface. Except for stretch in the cable, the cage follows the motion of the ship. Therefore, motion compensation is necessary so that there is no relative motion between the cage and the vehicle. Motion compensation is accomplished in two basic ways: Actively, using a feedback system to drive actuators to eliminate the relative motion between the vehicle and cage, and passively, using actuators supported by a pneumatic system that acts as a very soft shock absorber. The actuators generally drive a crane or A-frame boom (boom bobber) which supports the cable. A ram tensioner including ram sheaves through which the tether is reeved can also be used, but is generally undesirable because of fatigue effects on the tether. Both of these systems use hydraulic cylinders to drive the crane that supports the tether cable in an effort to eliminate the vertical motion of the end of the crane. Both systems are costly to build and maintain due to their complexity. Motion compensation may also be required for vehicle/cage systems in order to avoid cable resonance during vehicle excursions 10,000 feet below the ocean surface.

An additional problem with deep diving vehicle/-cage systems is not generally recognized: as operating depths become deeper, the vehicle and cage components become larger and heavier. Hence, the strength of the secondary cable relative to the vehicle mass diminishes. Thus, if the vehicle and cage drift apart, any resulting snap load can easily damage the secondary cable. Although the vehicle/cage approach greatly simplifies surface handling, it results in a second submersible, complex surface motion compensation equipment, and a complex submerged docking operation.

Thus, a need exists for a shipboard vehicle handling system that can launch and retrieve submersible vehicles that avoids the complexity and difficult underwater handling of the vehicle/cage systems, and the deployment and recovery problems of the submersible only system.

SUMMARY OF THE INVENTION

The present invention overcomes the aforementioned problems of the submersible only systems and the vehicle/cage systems by providing a simplified handling system for launching and recovering deep diving, remotely operated submersible vehicles from a ship underway. The present invention is a vehicle handling system (VHS) that is capable of launching and recovering a tethered submersible vessel from a ship, and includes a gantry pivotally mounted on the aft end of the deck of the ship. The gantry pivots in an arc extending over and beyond the deck upon actuation by a pair of double acting hydraulic cylinders. A head sheave is pivotally mounted to swing for and aft from the top of the gantry. A winch operably coupled to the lift line controls the lift line payout length. A tether which provides a communicative link from the ship to the submersible vessel is operably coupled to a traction drive mounted on the deck and is stored on a spool. The tether may be selectively passed about a hanging sheave suspended from the gantry in order to reduce stress in the tether while the submersible vessel is submerged. A saddle pivotally mounted to the gantry is selectively coupled to the submersible vessel in order to transfer the submersible vessel between being positioned on the deck of the ship and being suspended over the ocean by the lift line.

DESCRIPTION OF THE PREFERRED EMBODIMENT

Figure 1:
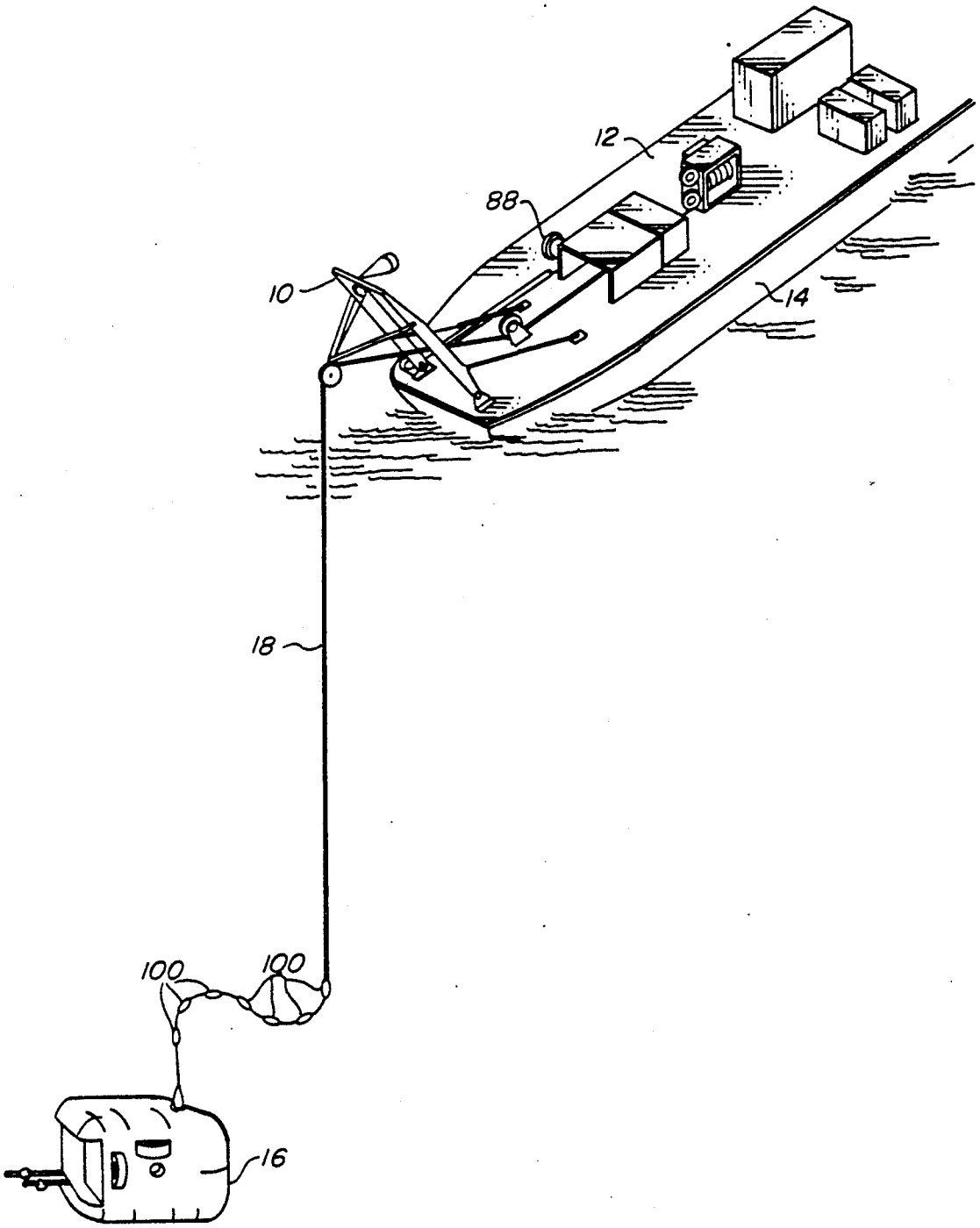
FIG. 1 is a perspective view of the submersible vehicle deployed at depth within the ocean and linked by the tether to the ship.

Referring to the drawings wherein like reference numerals designate like or similar parts throughout the several views, there is illustrated in FIG. 1 vehicle handling system (VHS) 10 mounted towards the stern of deck 12 of ship 14 for deploying and recovering submersible vehicle 16 linked to ship 14 by tether 18.

Figure 2:
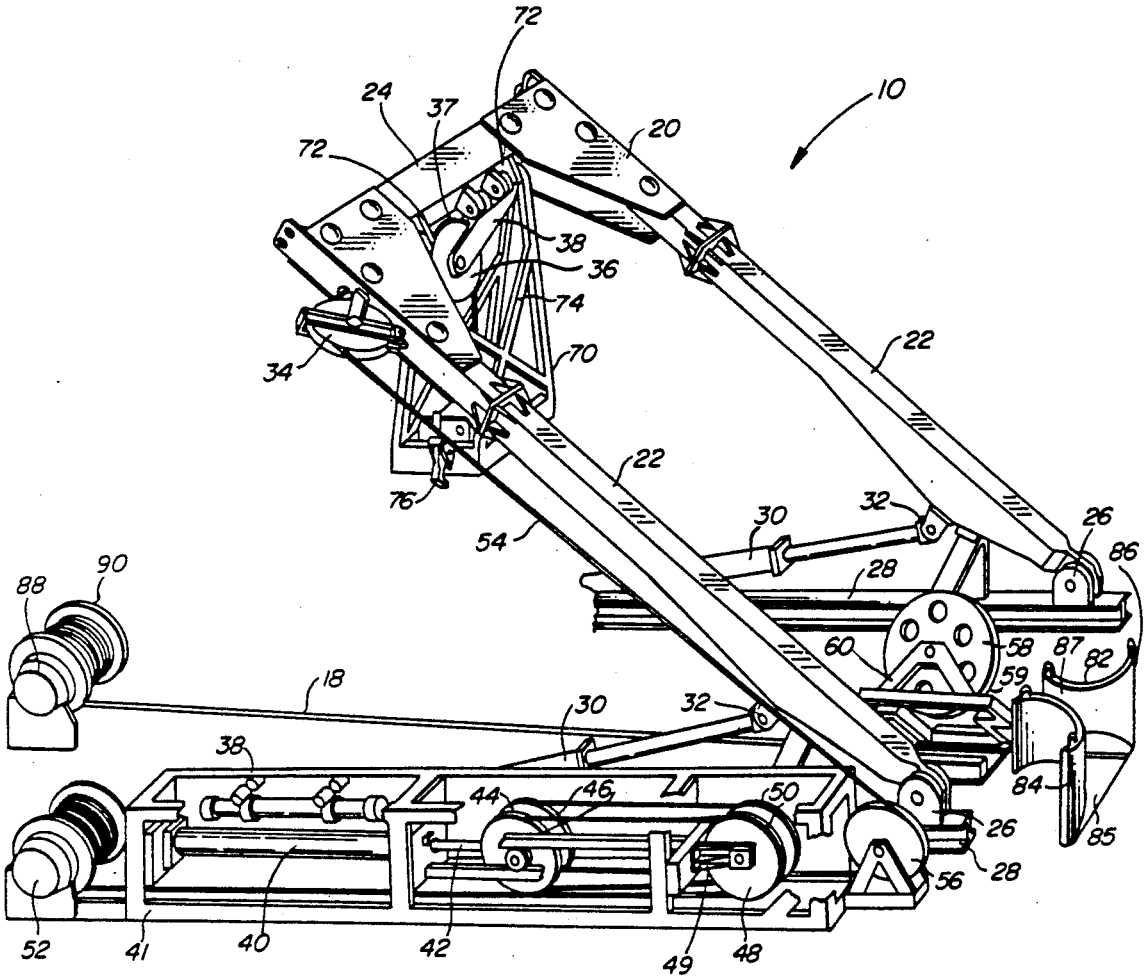
FIG. 2 is a perspective view of the vehicle handling system.

VHS 10 is shown in greater detail in FIG. 2 and includes gantry 20 having vertical supports 22 connected by overhead center support 24. Vertical supports 22 are pivotally mounted to pivot supports 26 by means well known to those skilled in this technology. Pivot supports 26 are fixedly mounted to support rails 28, as for example by welding, that are attached to deck 12. Double acting cylinders 30 are pivotally attached to support rails 28 and to pivot supports 32 mounted on vertical supports 22. Double acting cylinders 30 are selectively pressurized by means well understood by those skilled in this art and enable gantry 20 to be pivoted in an arc that defines a plane which is preferably coincident with the longitudinal axis of ship 14 and which extends from over the stern end of deck 12 out beyond the stern of ship 14. In the preferred embodiment, cylinders 30 are pressurized with hydraulic fluid. Fairlead sheave 34 is pivotally mounted to one vertical support 22, as shown. Head sheave 36 having groove 37 pivots within sheave yoke 38 that is pivotally mounted to the underside of center support 24 so that head sheave 36 may swing for and aft with respect to the bow and stern of ship 14.

Still referring to FIG. 2, ram tensioner 38 which may be attached to deck 14 substantially adjacent to gantry 20, as shown, includes double acting cylinder 40 supported within ram tensioner frame 41. Ram tensioner 3 limits tensile stresses in lift line 54 attributable to relative motion between ship 14 and submersible 16. Although, ram tensioners are well known to those skilled in this art, ram tensioner 38 is described herein to facilitate comprehension of the present invention. Actuating rod 42 slides in and out of cylinder 40 in response to the pressure therein provided by means not shown since actuation of double acting cylinders is well known by those of ordinary skill in this art. Sheaves 44 having grooves 46 are rotatively mounted side by side to the external end of actuating rod 42. Sheaves 48 having grooves 50 are rotatively mounted side by side to brackets 49 which are attached to ram tensioner frame 41 such that grooves 50 align with grooves 44 and remain aligned regardless of the degree of actuation of rod 42. Powered winch 52, which may be mounted to frame 41, pays out and winds in lift line 54. Lift line 54 is reeved around sheaves 44 and 48, and passes about sheave 56, which for example, may be rotatively mounted to frame 41, fairlead sheave 34 and head sheave 36. In the preferred embodiment, it is desirable for the rotational axis of sheave 56 to be coincident with the pivot axis of gantry 20 at pivot supports 26 in order to reduce the change in lift line length during rotation of gantry 20. Ram tensioner 3 compensates for varying loads induced in lift line 54 to limit tension therein. The operating fluid within the ram tensioner cylinder 40 is hydraulic fluid such as hydraulic oil. During submersible vehicle deployment and retrieval, and during operation of the hanging sheave, the hydraulic fluid is pressurized communicably by nitrogen in accordance with techniques well known by those of ordinary skill in this art. This establishes a means of reducing tension variations in the lift line 54 due to the accumulator effect of the nitrogen volume. This volume and pressure can be varied during the operation depending on the loads supported by the lift line 54.

Figure 3:
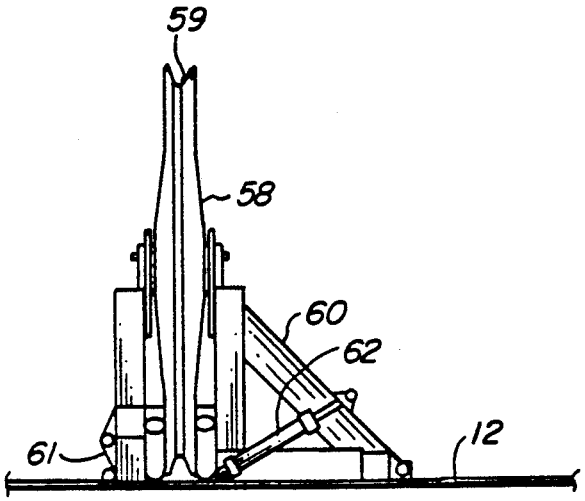
FIG. 3 illustrates the topple sheave in the engaged position.
Figure 4:
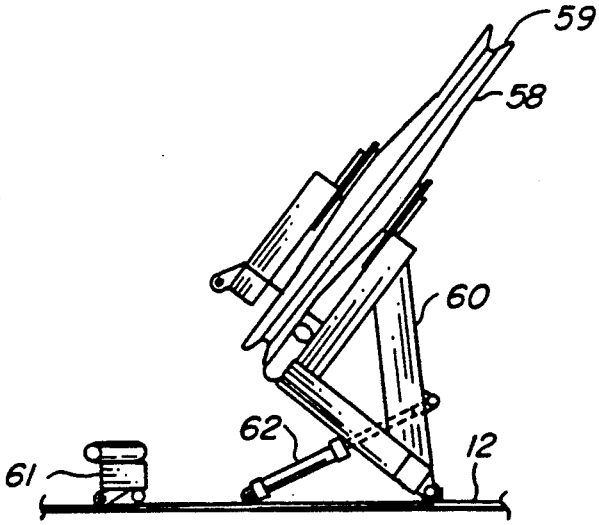
FIG. 4 illustrates the topple sheave in the disengaged position.

As illustrated in FIGS. 3 and 4, topple sheave 58 having groove 59 is rotatively mounted within sheave yoke 60 that is pivotally mounted to deck 12 so that sheave yoke 60 may swing in an arc upon actuation, in accordance with well known techniques of, double acting cylinder 62. Groove 59 of topple sheave 58 is aligned with groove 37 of head sheave 36 when topple sheave 58 is in the engaged position, i.e., where cylinder 62 is in the retracted position and sheave yoke 60 rests on pivot stop 61, as shown in FIG. 3. FIG. 4 shows topple sheave 58 in the disengaged position where cylinder 62 is extended.

Figure 6:
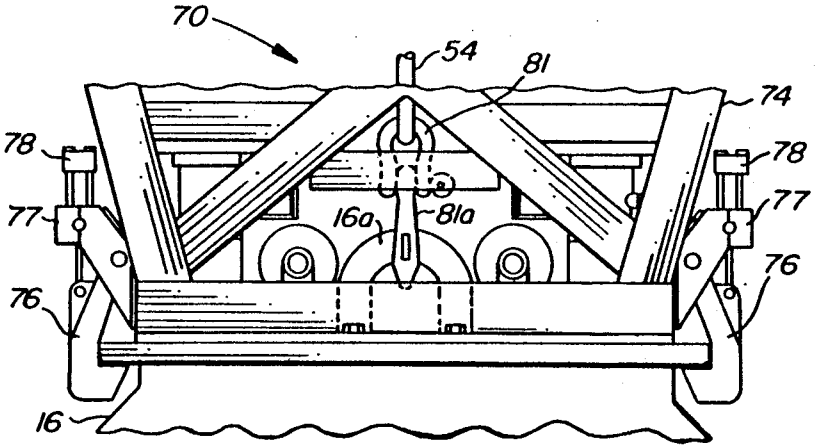
FIG. 6 illustrates the toggle clamps engaged to hold the submersible vehicle against the saddle.
Figure 5:
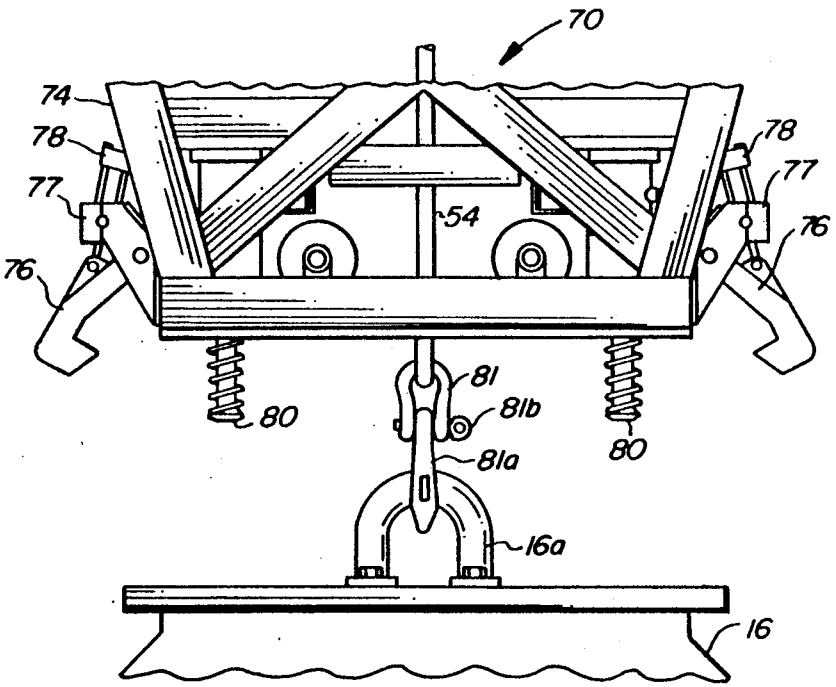
FIG. 5 illustrates the toggle clamps in the disengaged position.

Referring to FIGS. 2, 5, and 6 collectively, saddle 70 is pivotally mounted to pivot supports 72 which are attached to the underside of center support 24. The purpose of saddle 70 is to support submersible vehicle 16 and prevent it from swinging side to side. Saddle 70 includes three dimensional frame 74 which may be constructed of tubing having a rectangular cross-section. Toggle clamps 76 are pivotally mounted to brackets 77 which are welded to the bottom of the starboard and port sides of frame 74. Double acting cylinders 78 are pivotally mounted between frame bracket 77 and toggle clamp 76. Actuation of toggle clamps 76 is implemented by extension and retraction of double acting cylinders 78 from pressurization, as is well known by one of ordinary skill in this technology. Toggle clamps 76 engage to attach submersible vehicle 16 to saddle 70 during deployment and retrieval of submersible vehicle 12. FIG. 5 illustrates toggle clamps 76 in the disengaged position, where cylinders 78 are retracted. Lift line 54 may be selectively extended through saddle 70 and terminated with clevis 81. Hook 81*a* is attached to clevis 81 by pin 81*b* and supports vehicle 16 at "U"-bolt 16*a*, fastened to submersible vessel 16. Spring stops 80 extend downwardly from the bottom of frame 74 to engage submersible vehicle 16 so that it can be held tightly against saddle 70 when toggle clamps 76 are engaged. Spring stops 80 also act as shock absorbers as the vehicle is pulled into the saddle. This lets the operator pull the lift line in rapidly without worrying about slamming the vehicle into the saddle. FIG. 6 illustrates toggle clamps 76 in the engaged position with cylinders 78 extended, where submersible vehicle 16 is shown to be clamped to the underside of saddle 70.

Again referring to FIG. 2, tether chute 82 is fabricated from curved plates 84, 85, and 86 that define tapered channel 87 and is mounted to the stern end of deck 12 such that channel 87 is substantially coincident to the longitudinal axis of ship 14.

Figure 7:
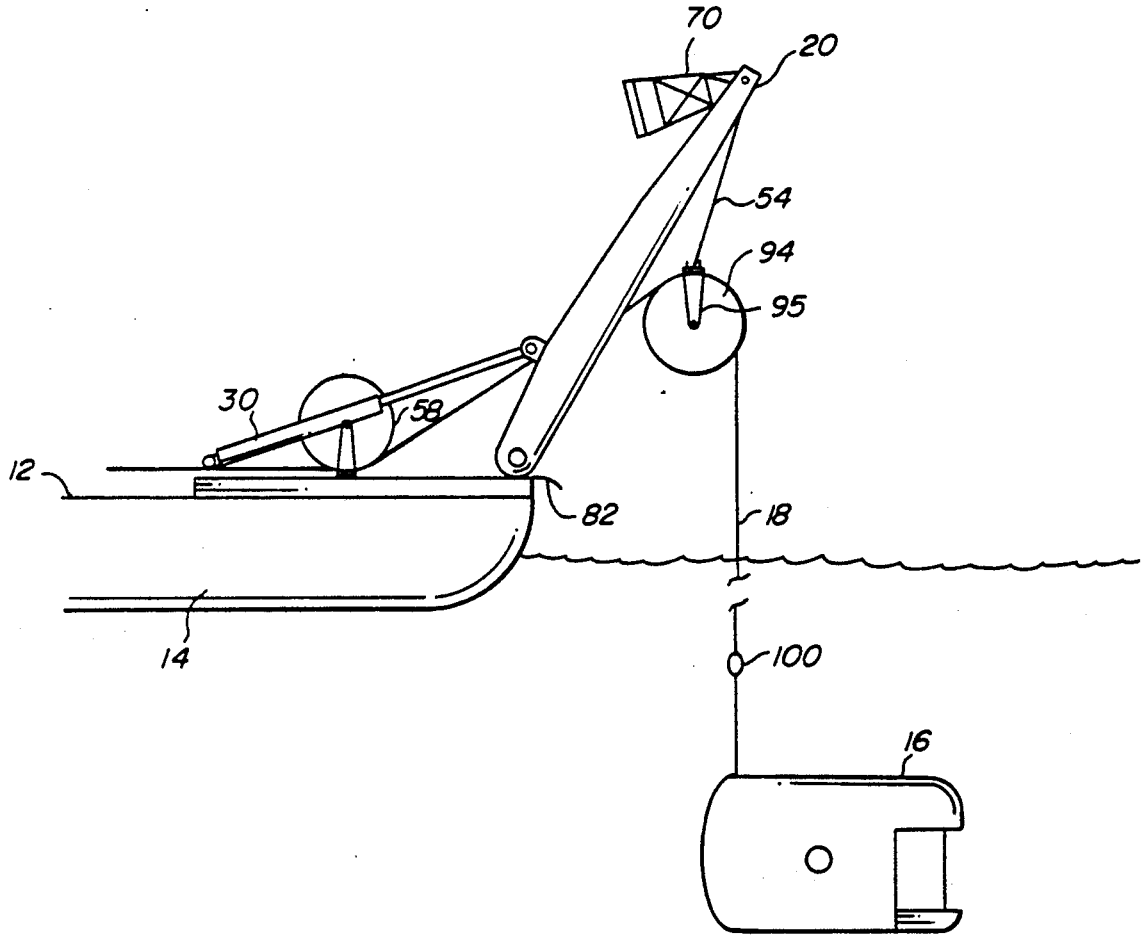
FIG. 7 illustrates the hanging sheave supporting the tether.
Figure 9:
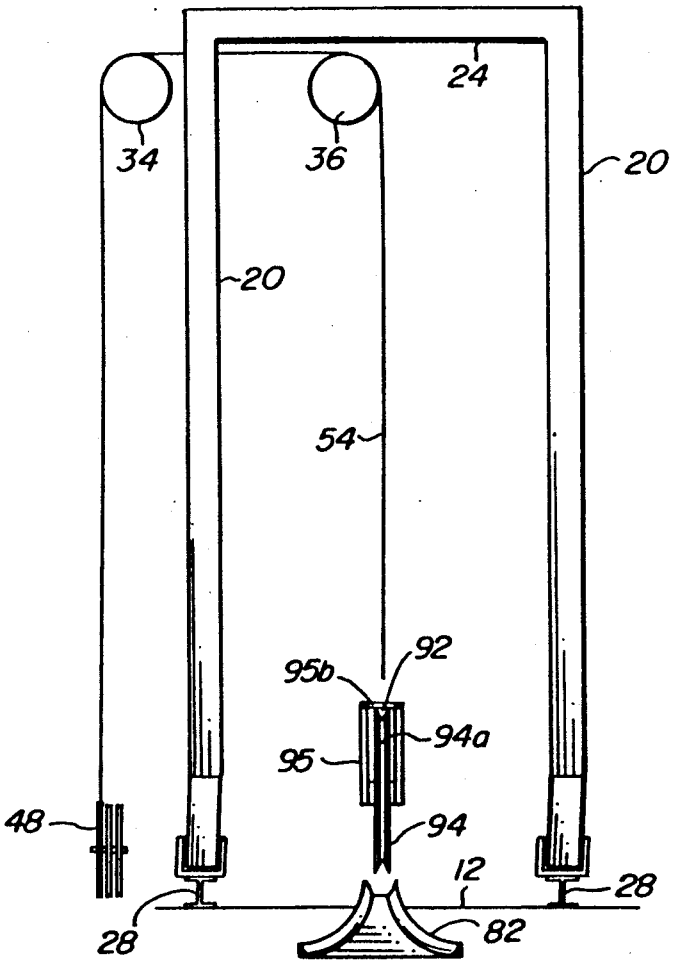
FIG. 9 is a schematic drawing of the hanging sheave supporting the tether.
Figure 8:
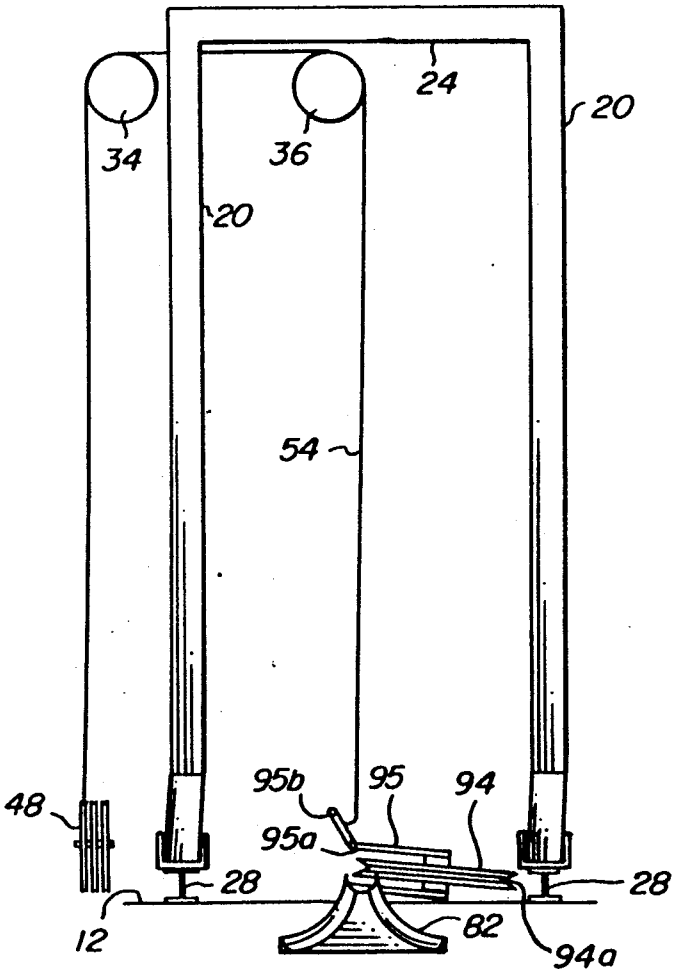
FIG. 8 is a schematic drawing of the hanging sheave lying on deck of the ship.

Referring to FIGS. 7, 8, and 9 collectively, vehicle handling system 10 also includes hanging sheave 94, having groove 94*a*, which selectively supports tether 18 in order to avoid inducing excessive tensile stresses in tether 18 while submersible 16 descends in the ocean or while operating near the sea floor. Hanging sheave 94 is rotatably mounted in sheave yoke 95 having yoke end 95*a* which is open. Latch 95*b* is pivotally mounted to yoke end 95*a* and is locked to yoke 95 by means well understood by those skilled in this art. Referring to FIGS. 7, 8, and 9, collectively, latch 95*b* is attached to lift line 54 so that hanging sheave 94, supported within yoke 95, may be selectively suspended. When desired to support tether 18 by hanging sheave 94, lift line 54 is hoisted by techniques well within the level of ordinary skill of one practicing this technology after tether 18 is placed into groove 94*a*, and then latch 95*b* is closed and locked. FIG. 8 illustrates hanging sheave 94 resting on deck 14. FIG. 9 illustrates hanging sheave 94 supporting tether 18.

Figure 10:
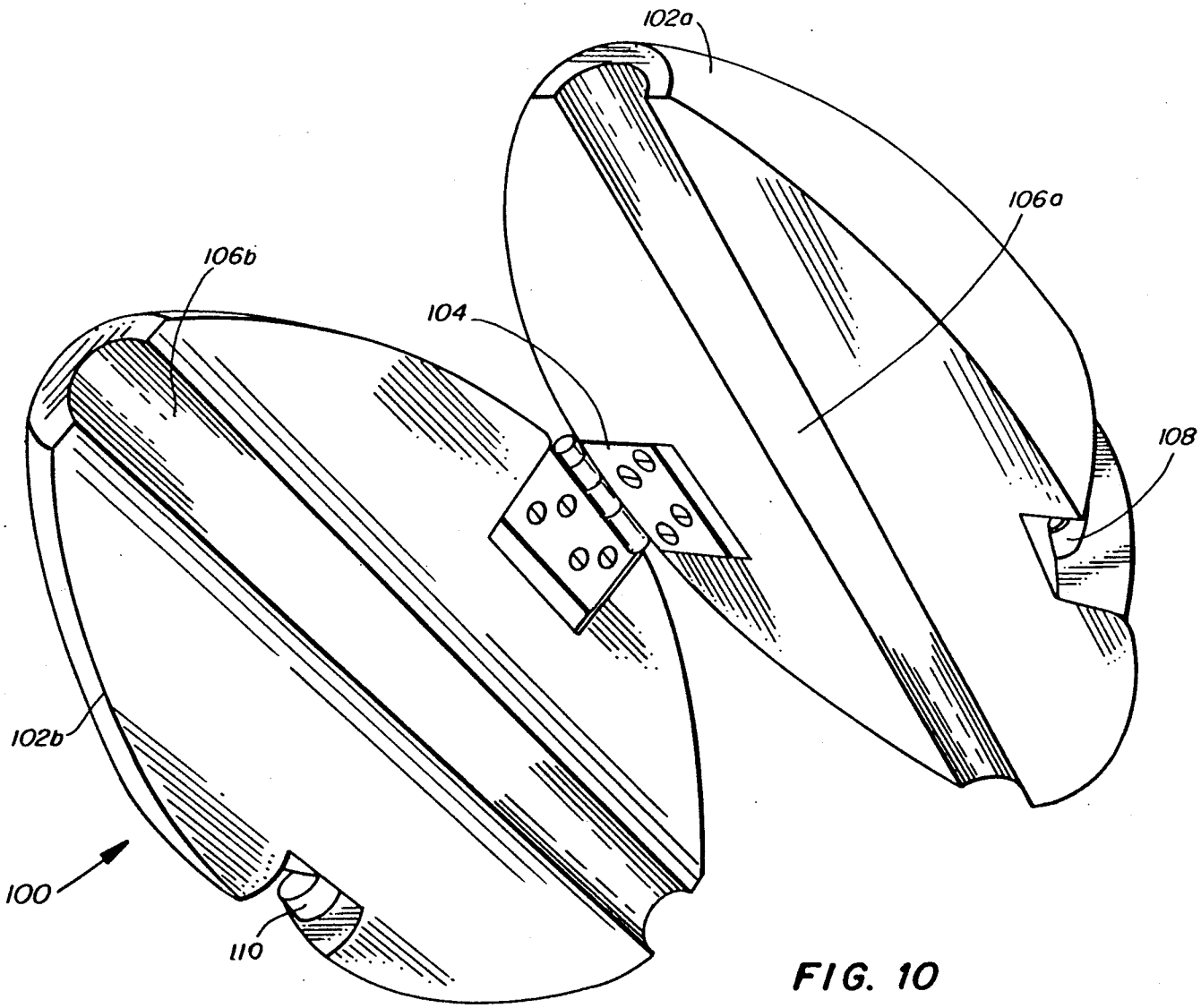
FIG. 10 depicts the floatation collar.
Figure 11:
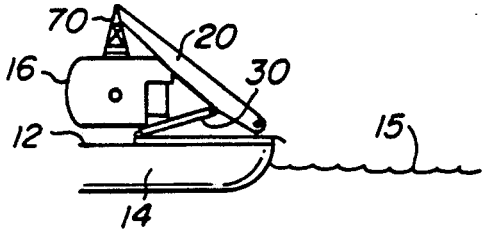
FIGS. 11 through 15 schematically illustrate the sequence of steps for launching the submersible vehicle.
Figure 12:
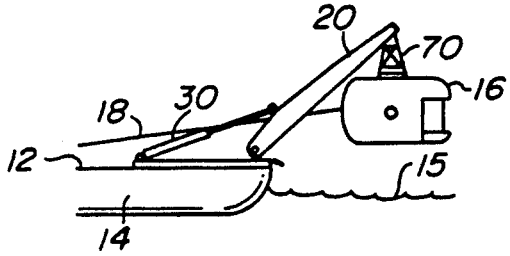
Figure 13:
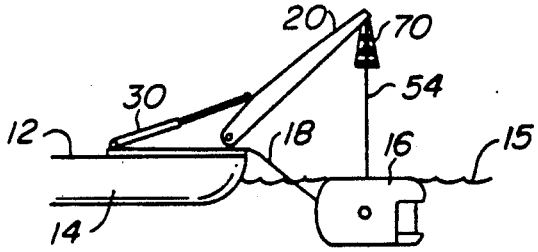
Figure 14:
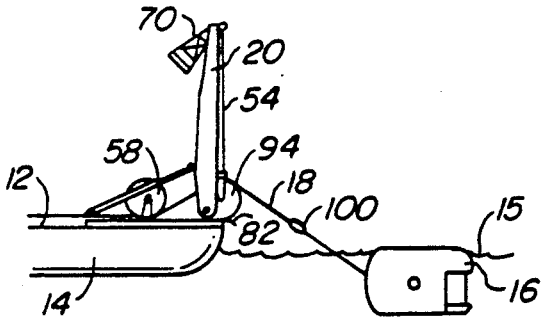
Figure 15:
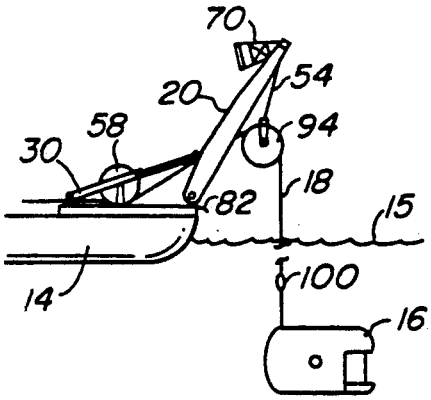

Referring to FIG. 1, a section of tether 18 near vehicle 16 is rendered neutrally buoyant with floatation collars 100 in order to decouple transmission of tensile forced through tether 18 due to relative motion between ship 14 and vehicle 16. One suitable implementation of floatation collar 100 is illustrated in FIG. 10, where floatation collar 100 is shown comprised of two semi-ellipsoid shaped sections 102*a* and 102*b* connected by hinge 104. Semi-ellipsoid sections 102*a* and 102*b* each include longitudinal, semicircular grooves 106*a* and 106*b*, respectively, having a diameter slightly larger than the diameter of tether 18. Clasp 108 is affixed to section 102*a* and clasp receptacle 110 is attached to section 102*b*. In operation, sections 102*a* and 102*b* are placed about tether 18 and closed so that tether 18 is positioned within grooves 106. Clasp 108 then engages clasp receptacle 110. Of course, it is to be understood that floatation collar 100 may be implemented other than as shown and described herein.

Figure 16:
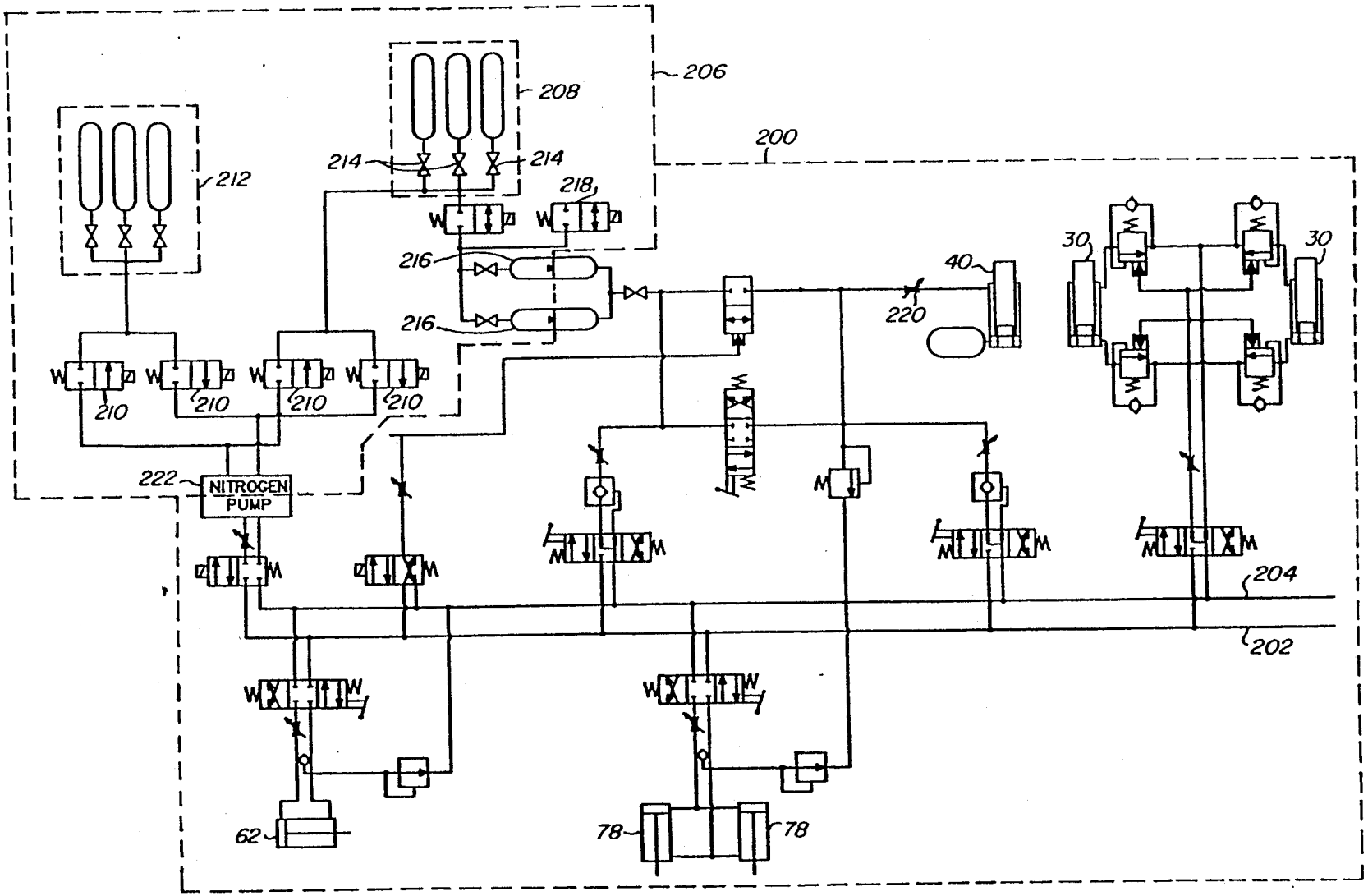
FIG. 16 is a schematic diagram of the hydraulic and nitrogen systems.

Vehicle handling system 10 is controlled by hydraulic circuit 200 having hydraulic pressure supply 202 and return 204, and nitrogen circuit 206, as depicted in FIG. 16. The purpose of nitrogen system 206 is to provide a pneumatic spring or shock absorber for double acting cylinder 40 of ram tensioner 38. The spring constant of ram tensioner 38 is a function of the pressure and volume of nitrogen bank 208. The pressure of nitrogen bank 208 is adjusted by use of switching valves 210 which are used to exchange nitrogen with nitrogen storage 212. Nitrogen bank 208 is charged or vented through 214. Hydraulic oil in double acting cylinder 40, and between double acting cylinder 40 and nitrogen accumulators 216 provides a mechanical link between these components. Nitrogen may be pumped from nitrogen bank 208 to nitrogen storage 212 to reduce the pressure of nitrogen bank 208 and to conserve nitrogen. Vent valve 218 is used to reduce pressure in nitrogen bank 208 in an emergency. Damping actuation of double acting cylinder 40 is provided by hydraulic flow control valve 220, which can be adjusted to reduce the speed of ram tensioner 38 and thereby reduce its frequency response. Nitrogen pump 222 is hydraulically powered as shown.

OPERATION OF THE INVENTION

An overview of the deployment of submersible vehicle 16 is most readily understood with reference to the ensuing description and FIGS. through 15. Initially, submersible vehicle 16 rests on board ship 14, floating on ocean 15, just forward of gantry 20. Double acting cylinders 30 are retracted so that gantry 20 is positioned such that the bottom of saddle 70 is positioned above the top of submersible vehicle 16 located on deck 12. Lift line 54 then is threaded through saddle 70 and is attached to the top of submersible 16 so that lift line 54 may be used to raise submersible 16 into the saddle. Double acting cylinders 78 are extended so that saddle 70 latches to submersible vehicle 16. Tether 18 may be coupled to one end of submersible vehicle 16 to facilitate towing so as to provide vehicle 16 with stable dynamics while being towed. Lift line 54 is threaded through saddle 70 and hook 81*a* is attached to "U"-bolt 16*a*, fastened to submersible 16, as illustrated in FIGS. 5 and 6. Gantry 20 is swung in an arc to position submersible vehicle 16 beyond the stern of ship 14 over the ocean by extending double acting cylinders 30. Saddle 70 then is uncoupled from submersible vehicle 16 by retracting cylinders 78 of saddle 70. Winch 52 is operated to slowly pay out lift line 54, causing submersible vehicle 16 to be gently lowered into the ocean. Ram tensioner 38 is also engaged so that as the vehicle enters the ocean, tension is maintained on lift line 54 until vehicle 16 is floating. When vehicle 16 is floating, hook 81*a* is released. Deployment of vehicle 16 may occur while ship 14 is underway at approximately 1–2 knots. As submersible vehicle 16 is lowered into the ocean, tether 18 is deployed from storage drum 90 using traction winch 88. Tether 18 is placed into channel 86 of tether chute 82. Tether 18 continues to be deployed as buoyant flotation collars 100 are manually attached to tether 18 to create a "whip" which decouples motion of tether 18 where it is attached to ship 14 from the motion of tether 18 where it is attached to submersible vehicle 16. Winch 52 then winds in lift line 54 enough so that lift line 54 may be unthreaded from saddle 70 in order to stow away saddle 70.

Gantry 20 is rotated forward and positioned so that lift line 54 can hoist hanging sheave 94 via latch 95*b*. Tether 18 is inserted through yoke end 95*a* into groove 94*a* of hanging sheave 94 and locked in hanging sheave yoke 95 by closing latch 95*b*. Winch 52 reels in lift line 54 to raise hanging sheave 94 with tether 18 positioned in groove 94*a* of hanging sheave 94. Gantry 20 is rotated aft until the handing sheave 94 is suspended behind the ship. Winch 52 reels out lift line 54, lowering hanging sheave 94 until the tether 18 contacts chute 85.

Double acting cylinder 62 is retracted so that groove 59 of topple sheave 58 engages tether 18 causing tether 18 to pass about the bottom of topple sheave 58. Lift line 54 may then be payed in to raise hanging sheave 94 as operating conditions warrant.

Ram tensioner 38 is pressurized during launch and recovery of vehicle 16 to prevent snap loading of lift line 54 that could otherwise severely damage tether 18 from tensile forces induced in tether 18 due to relative motion between ship 14 and submersible 16. The operating pressure of ram tensioner 38 is set so that line tension in lift line 54 is maintained at a suitable level within the tensile limits of line 54 as vehicle 16 is lowered or raised. The operating pressure is periodically adjusted to compensate for changes in the deployed weight of tether 18 as it is payed out or reeled in. Ship 14 stops at a desired operating site and as tether 18 is payed further out, submersible vehicle 16 descends into ocean 15. Retrieval of submersible vehicle 16 is the reverse of deployment.

Obviously, many modifications and variations of the present invention are possible in light of the above teachings. It is therefore to be understood that within the scope of the appended claims the invention may be practiced otherwise than as specifically described.

I claim:

1. An apparatus for launching, towing, and recovering a tethered submersible vessel from a ship, comprising:

a frame mounted to said ship;

a gantry pivotally mounted to said frame and having a support member;

means for selectively pivoting said gantry;

a head sheave pivotally mounted to swing from said support member;

a lift line passing about said head sheave and having first and second ends, said first end of said lift line coupled to said submersible vessel when said vessel is being launched and when being recovered;

a hanging sheave rotatively suspended from said first end of said lift line when said submersible vessel is being towed;

a winch operably coupled to said second end of said lift line;

a tether coupled between said ship and said submersible vessel, and selectively passing about said hanging sheave when said submersible vessel is being towed;

means for paying out and winding in said tether;

a saddle pivotally mounted to said support member for selectively engaging said vessel; and means mounted to said frame and about which said lift line passes for limiting tensile stresses in said tether.

2. The apparatus of claim 1 wherein:

said means for pivoting said gantry includes at least one double acting cylinder having a first end pivotally mounted to said frame and a second end pivotally mounted to said gantry; and a pressurized fluid source for selectively pressurizing said double acting cylinder.

3. The apparatus of claim 2 wherein:

said means for limiting tensile stresses in said tether is a ram tensioner.

4. The apparatus of claim 3 which further includes:

a topple sheave pivotally mounted to said frame for selectively engaging said tether.

5. The apparatus of claim 4 wherein said means for paying out and winding in said tether includes;

a spool around which said tether is selectively wound and unwound; and a traction winch connected to said spool for winding and unwinding said tether.

6. The apparatus of claim 4 wherein:

said means for paying out and winding in said tether includes a powered winch.

7. The apparatus of claim 6 wherein said saddle further includes:

at least one toggle clamp mounted to said saddle.

8. An apparatus for launching, towing, and recovering a tethered submersible vessel from a ship, comprising:

a frame mounted to said ship;

a gantry pivotally mounted to said frame and having a support member;

at least one double acting cylinder having a first end pivotally mounted to said frame and a second end pivotally mounted to said gantry for selectively positioning said gantry;

a pressurized fluid source for selectively pressurizing said double acting cylinder;

a head sheave pivotally mounted to swing from said support member;

a lift line passing about said head sheave and having first and second ends, said first end of said lift line coupled to said submersible vessel when said submersible vessel is being launched and when being recovered;

a hanging sheave rotatively suspended from said first end of said lift line when said submersible vessel is being towed;

a winch operably coupled to said second end of said lift line;

a tether coupled between said ship and said submersible vessel, and selectively passing about said hanging sheave when said submersible vessel is being towed;

a ram tensioner mounted to said frame and about which said lift line passes for limiting stresses in said tether;

a spool around which said tether is wrapped;

a traction winch connected to said spool for winding and unwinding said tether; and a saddle pivotally mounted to said support member for selectively engaging said vessel.

9. The apparatus of claim 8 which further includes:

said ram tensioner includes a hydraulic cylinder.

10. The apparatus of claim 9 which further includes:

a topple sheave pivotally mounted to said frame for selectively engaging said tether.

11. The apparatus of claim 10 wherein said saddle further includes:

at least one toggle clamp mounted to said saddle.

12. An apparatus for launching, towing, and recovering a tethered submersible vessel from a ship, comprising:

a frame mounted to said ship;

a gantry pivotally mounted to said frame and having a support member;

at least one double acting cylinder having a first end pivotally mounted to said frame and a second end pivotally mounted to said gantry;

a pressurized fluid source for selectively pressurizing said double acting cylinder;

a head sheave pivotally mounted to swing from said support member;

a lift line passing about said head sheave and having first and second ends, said submersible vessel being suspended from said first end of said lift line when said vessel is being launched and when being recovered;

a hanging sheave rotatively suspended to said first end of said lift line when said submersible vessel is being towed;

a winch operably coupled to said second end of said lift line;

a tether coupled between said ship and said submersible vessel, and selectively passing about said hanging sheave when said submersible vessel is being towed;

a winch operably coupled to said tether for paying out and winding in said tether; and a saddle pivotally mounted to said support member for selectively engaging said vessel.

13. The apparatus of claim 12 which further includes:

a ram tensioner mounted to said frame about which said lift line passes.

14. The apparatus of claim 13 which further includes:

a topple sheave pivotally mounted to said frame for selectively engaging said tether.

15. The apparatus of claim 14 wherein said saddle further includes:

at least one toggle clamp mounted to said saddle.

16. An apparatus for launching, towing, and recovering a tethered submersible vessel from a ship, comprising:

a frame mounted to said ship;

a gantry pivotally mounted to said frame;

means for selectively pivoting said gantry;

a lift line supported by said gantry and releasably attached to said submersible vessel for supporting said submersible vessel when launching and recovering said submersible vessel;

a first winch operably coupled to said lift line for paying out and paying in said lift line;

a tether attached between said ship and said submersible vessel;

a hanging sheave releasably suspended from said lift line and about which said tether passes when said submersible vessel is towed so as to limit tensile loads in said tether;

a second winch mounted coupled to said tether for paying out and winding in said tether; and means mounted to said frame and about which said lift line is passed for limiting tensile stresses in said tether.

17. The apparatus of claim 16 in which:

said means for limiting said tensile stresses in said tether is a ram tensioner.

18. The apparatus of claim 17 in which:

said means for selectively pivoting said gantry includes a double acting cylinder pivotably mounted to said gantry and pivotably mounted to said frame.

19. The apparatus of claim 18 which further includes:

a saddle pivotally mounted to said gantry for selectively engaging said vessel.

* * * * *